US011735376B2

(12) United States Patent
Pedani

(10) Patent No.: US 11,735,376 B2
(45) Date of Patent: Aug. 22, 2023

(54) KEY SWITCH

(71) Applicant: PIAGGIO & C. SPA, Pontedera (IT)

(72) Inventor: Giuseppe Pedani, Pontedera (IT)

(73) Assignee: PIAGGIO & C. S.P.A., Pontedera (IT)

( * ) Notice: Subject to any disclaimer, the term of this patent is extended or adjusted under 35 U.S.C. 154(b) by 24 days.

(21) Appl. No.: 17/639,679

(22) PCT Filed: Sep. 2, 2020

(86) PCT No.: PCT/IB2020/058153
§ 371 (c)(1),
(2) Date: Mar. 2, 2022

(87) PCT Pub. No.: WO2021/048697
PCT Pub. Date: Mar. 18, 2021

(65) Prior Publication Data

US 2022/0293351 A1 Sep. 15, 2022

(30) Foreign Application Priority Data

Sep. 13, 2019 (IT) ..... 102019000016226

(51) Int. Cl.
*H01H 23/30* (2006.01)
*H01H 3/30* (2006.01)

(52) U.S. Cl.
CPC ..... *H01H 3/3047* (2013.01); *H01H 23/30* (2013.01); *H01H 2235/028* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20; H01H 23/143; H01H 23/30; H01H 23/025; H01H 2300/03; H01H 23/145;
(Continued)

(56) References Cited

U.S. PATENT DOCUMENTS 3,050,599 A 10/1960 Brevick
3,541,280 A 11/1970 Farrell
(Continued)

FOREIGN PATENT DOCUMENTS

DE 3835073 A 4/1989

OTHER PUBLICATIONS

International Search Report for corresponding application PCT/IB2020/058153 filed Sep. 2, 2020, dated Dec. 8, 2020.
(Continued)

*Primary Examiner* — Ahmed M Saeed
(74) *Attorney, Agent, or Firm* — Cantor Colburn LLP

(57) ABSTRACT

A key switch including: a support base; a key which is manually operable for being moved, with respect to the support base, between at least a first operating position and a second operating position spaced apart from each other, in order to establish or interrupt at least one electric connection; a leaf spring member operatively interposed between the support base and the key; wherein the first operating position is a stable operating position of the key in which the leaf spring member is deformed between the key and the support base so as to take a first curvilinear configuration.

11 Claims, 4 Drawing Sheets

(58) Field of Classification Search
CPC .. H01H 2221/016; H01H 23/14; H01H 23/04; H01H 23/168; H01H 2221/018; H01H 23/02; H01H 23/12; H01H 23/003; H01H 23/146; H01H 23/16; H01H 23/20; H01H 23/28; H01H 23/00; H01H 23/148; H01H 23/24; H01H 23/26
See application file for complete search history.

(56) References Cited

U.S. PATENT DOCUMENTS

| | | | | |
|---|---|---|---|---|
| 6,002,094 | A * | 12/1999 | Hung | H01H 23/08 200/438 |
| 6,833,521 | B2 * | 12/2004 | Nishikawa | H01H 1/5833 200/339 |
| 2015/0235794 | A1 * | 8/2015 | Rakuff | H01H 50/643 335/171 |

OTHER PUBLICATIONS

Written Opinion for corresponding application PCT/IB2020/058153 filed Sep. 2, 2020, dated Dec. 8, 2020.

* cited by examiner

KEY SWITCH

TECHNICAL FIELD OF THE INVENTION

The present invention relates to the technical field of electric switches and in particular it relates to a key switch. Such a switch is particularly suitable to be installed on transport vehicles, in particular on saddle-ride type vehicles, such as, for example motorcycles.

BACKGROUND OF THE INVENTION

Switches are known in the field of electric switches, having a manual operating key, e.g. a rocking key. Rocking key switches comprise a casing and a rocking key operatively attached to the casing and configured to rotate with respect to the casing between at least two operating positions angularly spaced apart from each other to establish or interrupt at least one electric connection. At least one of the two aforesaid operating positions of the rocking key is a stable position. For example, a switch in which the rocking key has two operating positions, one of which being unstable and the other stable, generally is used as a key to turn ON the traction engine of a motorcycle. Another example of rocking key switch is again used in motorcycles to switch a front light unit so that it generates a high or a low optical beam, in one of the stable operating positions and in the other of the two stable operating positions, respectively.

Key switches are also known in which the key, which is, for example rocking, is configured to take on three operating positions, two of which are stable and one of which is unstable. This latter type of key switch is again used in motorcycles to switch a front light unit so that it generates a high beam in a first stable operating position of the key, a low optical beam in a second stable operating position of the key, and so that it generates a high optical beam in the unstable operating position of the key. Generally, the second stable operating position is an intermediate position between the first stable operating position and the unstable operating position. A key switch of the above-described type is known from Patent Application IN201611029890 and Patent Application IN0925/DEL/2011.

In a key switch having at least one stable operating position, the key is automatically brought back into the stable operating position upon the release of a manual pressure force exerted on the key, and is retained in such a stable operating position by a piston loaded by a helical spring and sliding on a shaped surface, for example provided on a bottom wall of the casing, inside the latter. The stable operating position is the position of least deformation of the helical spring. Similar mechanisms are provided in key switches having two stable operating positions.

The presence of a sliding piston on a shaped surface in the above-described key switches of the known art causes certain drawbacks. Undesired jammings of the key may indeed occur, due to the wear of the surfaces or the frictions and/or the penetration of external materials in the switch, such as, for example water, dust, dirt. Moreover, due to the frictions between the surfaces involved in the sliding, a block of the key in an undesired position may occur. Moreover, an absence of smoothness may be detected in the operation of the key. Moreover, the assembly operations of the switches of the known art are relatively complex.

It is the general object of the present description to make available a key switch which is capable of completely or at least partially resolving the aforesaid drawbacks.

Such an object is achieved by means of a key switch, as defined in general in claim 1. Preferred and advantageous embodiments of the aforesaid key switch are defined in the appended dependent claims.

The invention shall be better understood by the following detailed description of particular embodiments thereof made by way of explanation and therefore, non-limiting, in reference to the accompanying drawings briefly described in the following paragraph.

DETAILED DESCRIPTION

Equal or similar elements are indicated with the same numeral references in the accompanying Figures.

Figure 1:
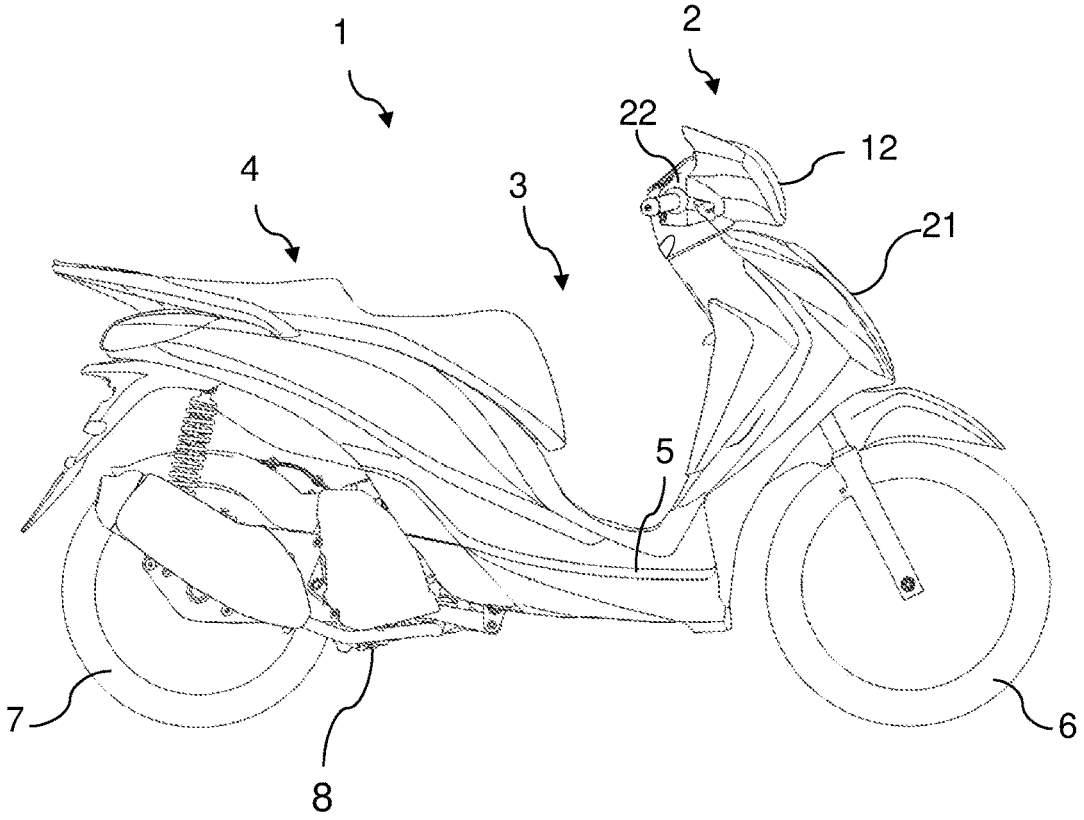
FIG. 1 shows a side plan view of a motorcycle comprising a first exemplary and non limiting embodiment of a key switch.
Figure 2:
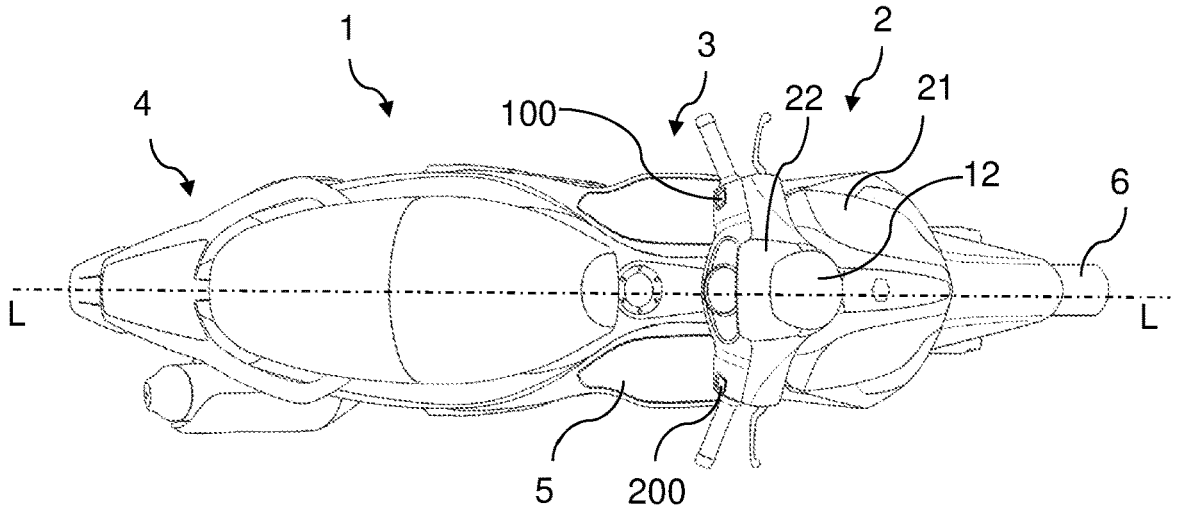
FIG. 2 shows a plan view of the motorcycle in FIG. 1.

Accompanying FIGS. 1 to 2 show an embodiment of a saddle-ride type vehicle 1 which in the particular example shown, is embodied, without introducing any limitation, in a two-wheel motorcycle and in particular, in a two-wheel scooter, having a front wheel 6 and a rear wheel 7.

From now on in the present description, without introducing any limitation, reference is made to a generic motorcycle 1, this meaning that the description of the following is generally applicable to any type of saddle-ride type vehicle comprising:

- a main body 2, 3, 4;
- at least two wheels 6, 7 restrained to the main body 2, 3, 4;
- an engine 8, for example a thermal or electric or hybrid traction engine, restrained to the main body 2, 3, 4 and operatively directly or indirectly connected to at least one of the two wheels 6, 7.

The main body 2, 3, 4 of motorcycle 1 extends along a longitudinal axis L-L, which is parallel to the driving axis of motorcycle 1, and has a front part 2, a tail part 4 and a middle part 3 interposed between the front part 2 and the tail part 4. The middle part 3 comprises, for example a walkable footboard 5.

In the example, the front part 2 comprises a front shield 21, a steering handlebar 22, the front wheel 6.

Motorcycle 1 comprises at least one headlight 12 attached to the front part 2 and at least one taillight 14 attached to the tail part 4. In a circumstance in which the steering handlebar 22 is not rotated, i.e. under the condition in which both the front wheel 6 and the rear wheel 7 are aligned along the longitudinal axis L-L, headlight 12 is such as to emit an optical beam, in particular a light beam, mainly directed along the longitudinal axis L-L to light up a portion of space located in front of motorcycle 1.

Motorcycle 1 further comprises a key switch 100 which is for example adapted and configured to allow the driver of motorcycle 1 to control headlight 12. For example, the key switch 100 is mounted on the steering handlebar 22 of motorcycle 1.

According to a possible embodiment, the key switch 100 allows the driver of motorcycle 1 to selectively control headlight 12 so it emits:

- a low light beam; or
- a high light beam; or
- a flashing with the high light beam during the emission of the low light beam;

From now on, the aforesaid embodiment is described, without introducing any limitation concerning the possibility of implementing different embodiments, even simpler ones, in which, for example the aforesaid key switch 100 is a switch for starting motorcycle 1, having one stable position alone and one unstable position alone, or in which the aforesaid key switch 100 has two stable operating positions, in which it allows the driver of motorcycle 1 to selectively control headlight 12 so it emits:

- a low light beam; or
- a high light beam.

The key switch 100 comprises:

- a support base 101;
- a key 102 which is manually operable for being moved, with respect to the support base 101, between at least a first operating position and a second operating position spaced apart from each other, in order to establish or interrupt at least one electric connection;
- a leaf spring member 103 operatively interposed between the support base 101 and key 102.

Figure 3:
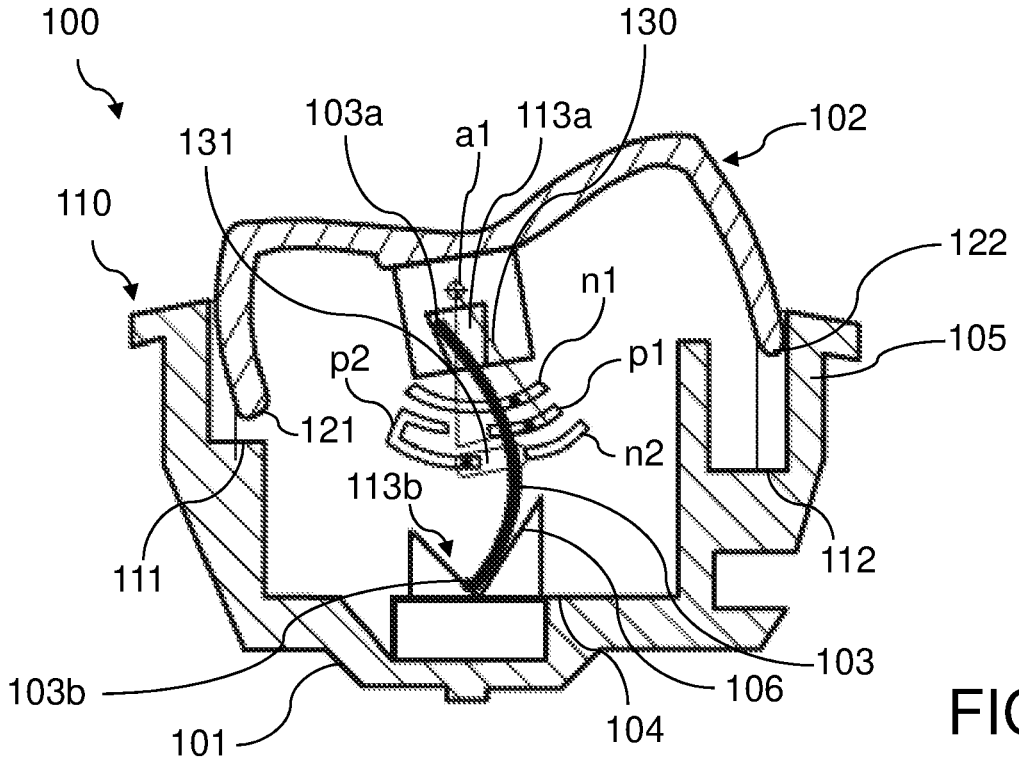
FIG. 3 shows a diagrammatic cross-sectional view of the key switch of the motorcycle in FIGS. 1 and 2, in which the switch is shown in a first operating configuration.
Figure 4:
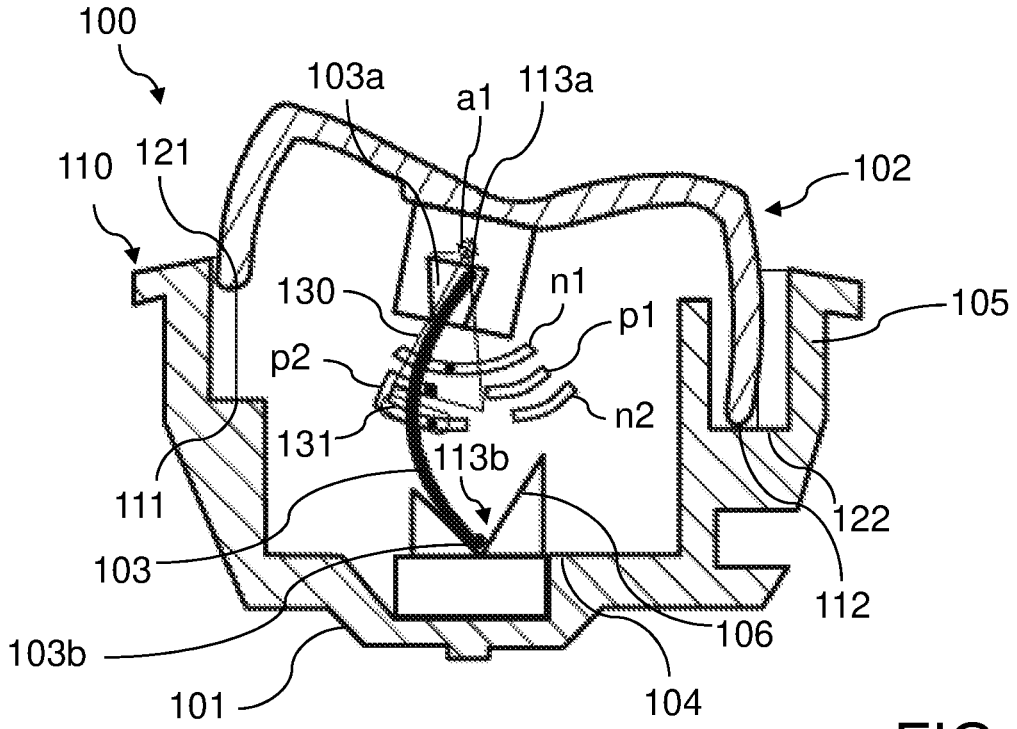
FIG. 4 shows a diagrammatic cross-sectional view of the key switch of the motorcycle in FIGS. 1 and 2, in which the switch is shown in a second operating configuration.

The first operating position of key 102 is a stable operating position in which the leaf spring member 103 is deformed between key 102 and the support base 101 so as to take on a first curvilinear configuration. For example, the first operating position is shown in FIG. 3 and the second operating position is shown in FIG. 4. For example, in the first operating position, the key switch 100 controls headlight 12 so that it emits a low light beam.

According to a preferred embodiment, the leaf spring member 103 is deformed between key 102 and the support base 101 because it is interposed and sandwiched between key 102 and the support base 101. This preferably occurs both in the first operating position and in the second operating position of key 102.

The support base 101 is, for example made of an electrically insulating material, for example hard plastic, for example of PA (polyamide). Conveniently, key 102 is made of an electrically insulating material, e.g. hard plastic, e.g. PA (polyamide).

The support base 101 is, for example the bottom wall 104 of a casing 110 of switch 100 to which key 102 is restrained in order to:

- rotate with respect to the support base 101 about a rotation axis a1, if key 102 is a rocking key; or
- slide with respect to the support base 101 parallel to the latter if key 102 is a sliding key.

According to an advantageous embodiment, the leaf spring member 103 is a leaf spring made of a metal material, e.g. harmonic steel.

In the embodiment depicted in the accompanying Figures, the leaf spring member 103 is formed by a single leaf. According to an alternative embodiment, the leaf spring member 103 may comprise two or more leaves so as to form an array of two or more leaves placed side-by-side, according to an arrangement which is typical of the so-called laminated springs.

Moreover, according to an embodiment, the leaf spring member 103 has a plate-like shape in the absence of external stresses, i.e. it is a planar leaf. However, according to an alternative embodiment, the leaf spring member 103, also in the absence of external stresses, may have a curvilinear shape, i.e. such an element is or comprises a leaf which is initially curved, i.e. curved before being interposed between the support base 101 and key 102 in assembly step of switch 1. This latter embodiment advantageously allows a certain difference to be created in the operating force required to move key 102, for example to rotate it or cause it to slide, in a direction with respect to the operating force required to move it in the opposite direction. The leaf spring member 103 may have a rectangular shape or a different shape, for example a shape of the hourglass type with the ends portions 103*a*, 103*b* of greater width, to improve the contact with base 101 and key 102, and a narrower middle part to decrease the operating effort.

According to an advantageous embodiment, the leaf spring member 103 extends between a first end portion 103*a* and a second end portion 103*b*, and the first end portion 103*a* is in contact with key 102. The second end portion 103*b* preferably rests directly, on the support base 101. For example, if switch 100 comprises a casing 110 in the shape of an open box-like body comprising a bottom wall 104 which defines the support base 101, a side wall 105 and an upper opening closed by key 102, it may be provided for the second end portion 103*b* of the leaf spring member 103 to rest on the bottom wall 104 of casing 110. According to an advantageous embodiment, the first end portion 103*a* and/or the second end portion 103*b* of the leaf spring member 103 is a curved or folded or rounded end portion or an end portion engaged in a rounded-tip safety element, for example a safety cap with a rounded tip (not shown in the Figures). This expedient allows a wear of the areas of key 102 and/or of the support base 101 which are in contact with the first and/or second end portion 103*a*, 103*b* of the leaf spring member 103, to be limited or avoided. This further allows the movement of key 102 to be made more smooth.

The interposition of the leaf spring member 103 with the respective ends 103*a*, 103*b* respectively in direct contact with the key 102 and the support base 101, allows to obtain a constructive simplification of the key switch 100 and a high degree of functionality.

In fact, the leaf spring member 103 deforms between the first and second position pushed by the direct action of the movement of the key 102. When the key 102 moves, the leaf 103 deforms without there being any intermediate elements that they switch their position. The movement of the key 102 therefore causes the direct deformation of the leaf spring member 103 and the relative switching between the two stable configurations.

According to advantageous embodiments, key 102 comprises a respective recess 113*a* adapted to house and retain the first end portion 103*a*, and/or the support base 101 comprises a respective recess 113*b* adapted to house and retain the second end portion 103*b*. This allows the correct positioning of the leaf spring member 103 to be ensured between the support base 101 and key 102. Conveniently, the recesses 113*a* and/or 113*b* may be shaped and sized so that the respective end portions 103*a* and 103*b* are engaged in such recesses but free to move therein.

In the particular example depicted in FIGS. 2 to 6, recess 113*a* defined in key 102 has a trapezoidal cross section. Moreover, recess 113*b* defined in the support base 101 has a triangular cross section. However, it is worth noting that the shapes of the recesses may be inverted, as recesses of different shapes from those herein specifically described and shown in the drawings may also be provided. For example, in the embodiment shown in FIGS. 7 and 8, recess 113*a* defined in key 102 has a rectangular cross section.

With reference to FIGS. 3 to 6, a first embodiment of switch 100 will be now described, in which the switch is a rocking key switch, i.e. in which switch 100 comprises a rocking key 102 adapted to be rotated about the rotation axis a1.

For matters of ergonomic nature, the rocking key 102 here preferably is a sawtooth key.

The first operating position of the rocking key 102 is shown in FIG. 3, and here is a stable operating position. According to a possible embodiment, also the second operating position of the rocking key 102 is a stable operating position, and in the second stable operating position, the leaf spring member 103 is deformed between the support base 101 and the rocking key 102 so as to take a second curvilinear configuration. For example, the second operating position of the rocking key 102 and the second curvilinear configuration of the leaf spring member 103 are shown in FIG. 4.

For example, in the second stable operating position of the rocking key 102, the key switch 100 controls headlight 12 so that it emits a high light beam.

According to a preferred embodiment, if the second operating position of the rocking key 102 is a stable operating position, the leaf spring member 103 is curved in a first direction in the first operating position (FIG. 3), and the leaf spring member 103 is curved in a second direction, opposite to said first direction, in the second operating position (FIG. 4). For this to occur, with reference to FIG. 6, during the passage between the first and the second operating position of the rocking key 102, and vice versa, the leaf spring member 103 takes on a transitional and unstable configuration in which it is curved in two opposite directions, for example so as to take on the shape of a wave.

Figure 5:
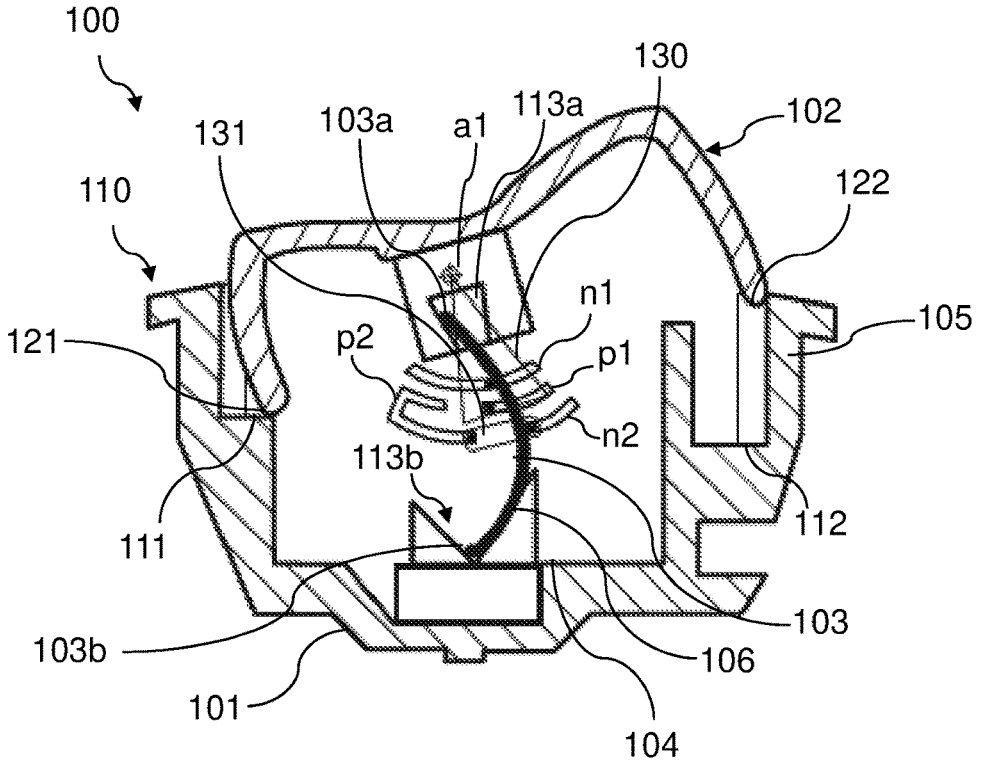
FIG. 5 shows a diagrammatic cross-sectional view of the key switch of the motorcycle in FIGS. 1 and 2, in which the switch is shown in a third operating configuration.
Figure 6:
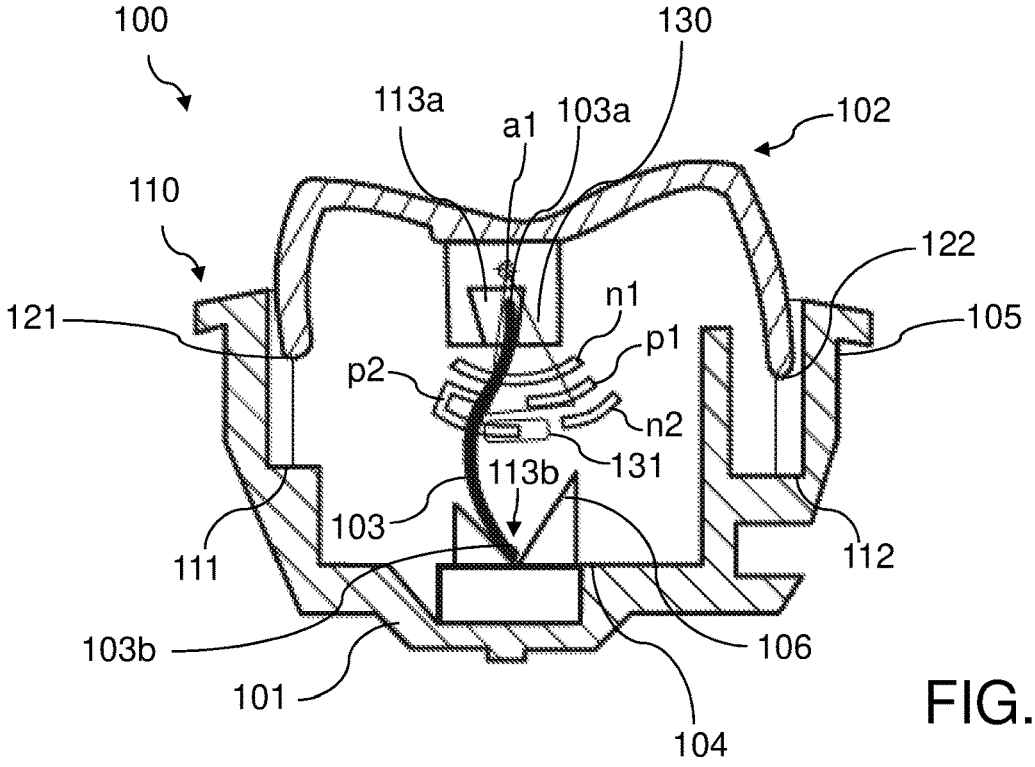
FIG. 6 shows a diagrammatic cross-sectional view of the key switch of the motorcycle in FIGS. 1 and 2, in which the switch is shown in a fourth transitional operating configuration between the first operating configuration and the second operating configuration.

According to one embodiment, the rocking key 102 of switch 100 is adapted to rotate to take on a third operating position, for example depicted in FIG. 5, which is angularly spaced apart from the first operating position (FIG. 3) and from the second operating position (FIG. 4). This third operating position is an unstable operating position. Here, the first operating position preferably is an intermediate position between the second operating position and the third operating position, whereby starting from the third operating position (FIG. 5), upon releasing a manual pressure exerted on the rocking key 102, the leaf spring member 103 is such as to attract back the rotating key 102 to the first operating position (FIG. 3). For example, in the third unstable operating position, the key switch 100 controls headlight 12 so that it emits both a high light beam and a low light beam to create a pass optical signal.

According to one embodiment, the key 102 switch 100 comprises at least one stop member 106 adapted to abut against the leaf spring member 103 when passing from the first operating position (FIG. 3) to the third operating position (FIG. 5) to limit a deformation of the leaf spring member 103. By limiting the maximum deformation of the leaf spring member 103 in the unstable operating position of the rocking key 103, it is advantageously avoided for the rocking key 102 to return towards the first stable operating position with excessive acceleration and/or speed, thereby avoiding for the rocking key 102 to even pass the first operating position, thus performing undesired oscillations. In the particular non-limiting embodiment in the Figures, the aforesaid stop member 106 is a tilted abutment wall integrated in the support base 101 or mounted on the support base 101.

According to one embodiment, the switch comprises end of stroke elements 112, 122, 121, 111. Such elements may be adapted and configured to establish one or more stable positions of the rocking key 102. For example, as shown in FIG. 4, the end of stroke elements 112 and 122 allow the rotation of the rocking key 102 to be stopped in the second stable operating position and comprise abutment surfaces, provided on the rocking key 102 and on casing 110, respectively, adapted to come into contact with each other in the second stable operating position. Moreover, the aforesaid end of stroke elements 112, 122, 121, 111 may also be adapted and configured to establish the unstable operating position of the rocking key 102. For example, as shown in FIG. 5, the end of stroke elements 112 and 122 allow the rotation of the rocking key 102 to be stopped in the third unstable operating position and comprise abutment surfaces, provided on the rocking key 102 and on casing 110, respectively, adapted to come into contact with each other in the unstable operating position.

According to one embodiment, the key switch 100 comprises at least one electrically conductive movable bridge 130, 131 mounted on the rocking key 102 to move together with the rocking key 102. Switch 100 further comprises at least two fixed contact members n1, n2, p1, p2 adapted to be electrically connected and disconnected to/from each other by means of the movable bridge 130, 131 according to the position taken by the rocking key 102.

In the particular example depicted, without introducing any limitation, the switch comprises two movable bridges 130, 131 and four fixed contact members n1, p1, n2, p2. The fixed contact members n1, n2 are for example connected to the negative pole of a battery on board motorcycle 1. The fixed contact members p1 and p2 are connected to the optical source which emits the low light beam and to the optical source which emits the high light beam, respectively.

In the configuration in FIG. 3, the movable bridge 130 is such as to electrically connect the fixed contact members n1 and p1 to each other. In this configuration, the key switch 100 controls the front light unit 12 so it emits a low light beam. In this configuration, the movable bridge 131 does not electrically connect the fixed contact members n2 and p2.

In the configuration in FIG. 4, the movable bridge 130 is such to electrically connect the fixed contact members n1 and p2 to each other. In this configuration, the key switch 100 controls the front light unit 12 so it emits a high light beam. In this configuration, the movable bridge 131 does not electrically connect the fixed contact members n2 and p2 either.

In the configuration in FIG. 5, the movable bridge 130 is such to electrically connect the fixed contact members n1 and p1 to each other, therefore the key switch 100 controls the front light unit 12 so it emits a low light beam. Moreover, in this configuration, the movable bridge 131 electrically connects the fixed contact members n2 and p2, therefore the key switch 100 controls the front light unit 12 so it also emits a high light beam.

According to an advantageous embodiment, the two movable bridges 130, 131 are two metal bridges separated from each other and attached to a common, electrically insulated support wall integrated in the rocking key 102 or mounted on the rocking key.

It is worth noting that although a particular configuration of fixed contact elements and movable bridges was described, various other configurations are possible, also according to the number of operating positions which the rocking key 102 may take on in relation to the functionalities to be performed by means of switch 100. For example, if the rocking key 102 is such as to take on two operating positions alone (for example two stable operating positions or one unstable operating position and one stable operating position), one of the two movable bridges 130, 131 alone and two fixed contact members alone may be provided. Again, in relation to the configuration of the contact elements and movable bridges, the content of the two above-mentioned patent publications IN201611029890 and IN0925/DEL/2011 is to be intended as entirely incorporated herein as reference.

Figure 7:
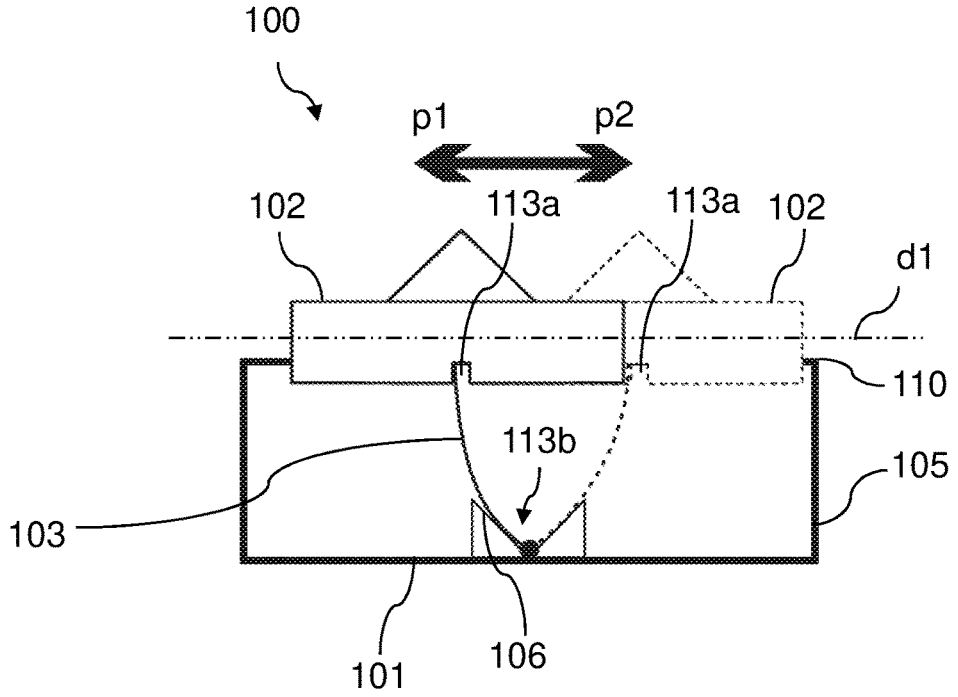
FIG. 7 shows a diagrammatic view of a second embodiment of a key switch, in which the switch is shown in a first operating configuration and in a second operating configuration.
Figure 8:
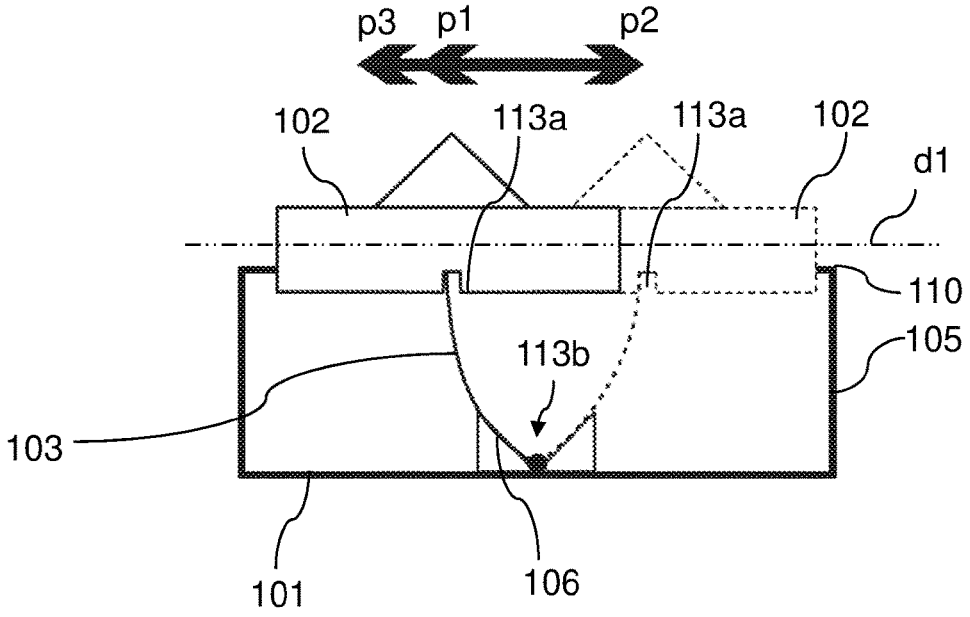
FIG. 8 shows a diagrammatic view of the key switch in FIG. 7, in which the switch is shown in the first operating configuration and in a third operating configuration.

With reference to FIGS. 7, 8, a variant embodiment of switch 100 is shown, in which rather than being a rocking key, key 102 is a sliding key. In other words, key 102 here is adapted and configured to slide with respect to the support base 101, parallel to the support base 101, i.e. without varying the distance between the support base 101 and key 102. The various operating operations of key 102 are therefore linearly spaced positions rather than being angularly spaced positions.

The description of the features of the above rocking key switch 100 made with reference to FIGS. 2 to 6 is applied mutatis mutandis to the switch in FIGS. 7 to 8, barring the only substantial difference that in this last case, key 102 is a key sliding along a sliding direction d1.

For example, in FIG. 7, key 102 depicted with solid lines depicts the key in the first stable operating position p1, for example the position corresponding to the position in FIG. 3, in which switch 100 controls headlight 12 so that it emits a low light beam. Key 102 depicted with dotted lines in FIGS. 7 and 8 depicts the key in the second stable operating position p2, for example the position corresponding to the position in FIG. 4, in which switch 100 controls headlight 12 so that it emits a low light beam. Key 102 depicted with solid lines in FIG. 8 represents the key in the third unstable operating position p3, for example the position corresponding to the position in FIG. 5, in which the key switch 100 controls headlight 12 so that it emits both a high light beam and a low light beam to create a pass optical signal.

It is also worth noting that also additional switches of the above-described type may be installed on board a motorcycle 1, for example a key switch 200 in which the key may take on a stable operating position and an unstable operating position, in which switch 200 allows an electric circuit to be closed to turn ON the traction engine 8 of motorcycle 1 in the unstable operating position and in which switch 200 allows such a circuit to be opened in the stable operating position.

According to what is explained above, it therefore may be understood how a key switch of the above-described type allows the above-mentioned objects to be achieved with reference to the known background art.

Indeed, the provision of a leaf spring member advantageously allows the problem of the jammings and of the lack of smoothness in the movement affecting the switches described above with reference to the known art to be resolved. Moreover, the assembly operations of the switch are simpler and a reduction in terms of number of components to be assembled may also be obtained.

Barring the principle of the invention, the embodiments and the embodiment details may be broadly varied with respect to what is described and disclosed by way of non-limiting example, however without departing from the scope of the invention as defined in the appended claims.

The invention claimed is:

1. A key switch comprising:

a support base;

a key which is manually operable for being moved, with respect to the support base, between at least a first operating position and a second operating position spaced apart from each other, in order to establish or interrupt at least one electric connection;

a leaf spring member operatively interposed between the support base and the key;

wherein:

the first operating position is a stable operating position of the key in which the leaf spring member is deformed between the key and the support base so as to take a first curvilinear configuration;

the second operating position is a stable operating position of the key, and wherein, in the second stable operating position, the leaf spring member is deformed between the support base and the key so as to take a second curvilinear configuration;

the leaf spring member extends between a first end portion and a second end portion, and wherein the first end portion is in contact with the key;

the second end portion directly rests on the support base.

2. A key switch according to claim 1, wherein the key is a rocking key adapted to rotate with respect to the support base about a rotation axis.

3. A key switch according to claim 1, wherein the key is a sliding key adapted to translate with respect to the support base along a sliding direction.

4. A key switch according to claim 1, comprising a casing having a bottom wall which defines said support base, a side wall and an upper opening, so as to define an open box-like body, wherein the upper opening is closed by the key, and wherein the second end portion rests on said bottom wall.

5. A key switch according to claim 1, wherein said first and/or said second end portion is a curved or folded or rounded end portion.

6. A key switch according to claim 1, wherein the key comprises a respective recess adapted to house and retain said first end portion and/or said support base comprises a respective recess adapted to house and retain said second end portion.

7. A key switch according to claim 1, wherein the key is adapted to be moved to take a third operating position spaced apart from said first and second operating positions, and wherein said third operating position is an unstable operating position.

8. A key switch according to claim 7, wherein the first operating position is an intermediate position between said second and third operating positions, whereby starting from the third operating position, upon releasing a manual pressure exerted on the key, the leaf spring member configured to attract back the key to the first operating position.

9. A key switch according to claim 8, comprising at least one stop member adapted to abut against the leaf spring member when passing from said first operating position to said third operating position to limit a deformation of the leaf spring member.

10. A key switch according to claim 1, comprising at least one electrically conductive movable bridge mounted on the key to be moved together with the key, and wherein the key further comprises at least two fixed contact members adapted to be electrically connected and disconnected to/from each other by means of the movable bridge based on the position taken by the key.

11. A saddle-ride type vehicle comprising at least one key switch according to claim 1.

* * * * *